United States Patent [19]

Ginnow et al.

[11] Patent Number: 4,487,355

[45] Date of Patent: Dec. 11, 1984

[54] NAILING MACHINE

[76] Inventors: Oscar H. Ginnow; Roger H. Ginnow, both of Hopbrook Rd., Bethany, Conn. 06525

[21] Appl. No.: 376,014

[22] Filed: May 7, 1982

[51] Int. Cl.[3] ..... B25C 1/04

[52] U.S. Cl. ..... 227/112; 227/113; 227/130

[58] Field of Search ..... 227/120, 112, 113, 130, 227/156

[56] References Cited

U.S. PATENT DOCUMENTS

| | | | |
|---|---|---|---|
| 2,829,369 | 4/1958 | Browning | 227/113 |
| 2,879,509 | 3/1959 | Congdon et al. | 227/130 X |
| 2,989,750 | 6/1961 | McIlvin | 227/130 X |
| 2,993,208 | 7/1961 | Cast et al. | 227/113 |
| 3,049,713 | 8/1962 | Dupuy et al. | 227/130 X |
| 3,553,816 | 1/1971 | Arnshaw | 227/112 X |
| 3,765,588 | 10/1973 | Frederickson | 227/113 |
| 4,049,181 | 9/1977 | Kametaki | 227/113 |
| 4,197,974 | 4/1980 | Morton et al. | 227/8 |
| 4,253,598 | 3/1981 | Haytayan | 227/119 |
| 4,313,552 | 2/1982 | Maurer | 227/109 |

*Primary Examiner*—Paul A. Bell

*Attorney, Agent, or Firm*—DeLio and Libert

[57] ABSTRACT

An improved nailing machine having a longitudinally reciprocating nail driving ram and a loose nail feeder means associated therewith, which feeds nails to an alignment chamber positioned in a plane adjacent to the stroke path of the driving ram. The nails are fed into the alignment chamber at an angle to the stroke path of the driving ram whereupon a magnet located adjacent to the driving ram rotates the nail from the initially inclined delivery position and draws it from the alignment chamber into a driving position aligned within the stroke path of the driving ram. The nailing machine may be operated pneumatically to facilitate rapid nailing operations, in which case nails are delivered to the alignment chamber by means of timed bursts of air down a pneumatic transfer tube leading from the loose nail feeder to the alignment chamber.

8 Claims, 10 Drawing Figures

CONTROL

NAILING MACHINE

BACKGROUND OF THE INVENTION

The present invention relates generally to nail driving devices and more particularly to a pneumatic nail driving machine for automatically fastening of pallets, boxes and the like.

Automatic or semi-automatic nailers are well known and typically are either portable, hand-held devices or larger, stationary machines which perform repetitive nailing operations. Of this latter type, to which our present invention pertains, it has heretofore been common to mount the machine in an upright manner such that the nailing operation is carried out solely in a vertical, downward direction. This vertical arrangement of known, stationary, nailing machines, of course, simplifies the feeding of nails thereto in that nails can be delivered to the machine merely by the force of gravity. While this gravity nail delivery method is, indeed, simple, it nevertheless, imposes an operational limitation upon the machine in that the machine is operable only in a vertical, downward direction. As a result, if the object being nailed, such as a pallet, requires nailing on opposite sides, it is necessary to first nail the top and then turn the pallet over in order to nail the bottom. This proves to be a time consuming and costly operation.

In an effort to solve this problem, it has been recognized that the nails could be collated into strips, held by clips or the like, and fed directly to the nailer, without the aid of gravity. A nail strip of this type is shown in U.S. Pat. No. 4,253,598. While this mode of nail transfer yields greater freedom in respect of nailing direction, it, likewise, increases the cost of the manufacturing operation as a result of the added expense of collated nails.

Attempts have also been made to feed individual nails, pneumatically, through a tube to hand-held nailers, as disclosed in U.S. Pat. Nos. 3,049,713 and 2,879,509. These prior devices deliver the nails directly into a cylindrical passageway adjacent to the driving ram. They generally utilize mechanically awkward, nail delivery systems having a number of moving parts which are prone to jam or malfunction during use.

It is also known to utilize magnets in nail driving devices as a means to hold and position a nail prior to being driven, as disclosed in U.S. Pat. Nos. 4,049,181, 2,829,369 and 4,049,181. These drivers utilize gravity fed nail systems which also possess the inherent vertical alignment shortcommings of the aforementioned devices.

In addition to the nail feeding and alignment problems heretofore encountered with known nailing machines, the problem of over-driving or wood splitting is a re-occurring problem due to the fact that the common driving ram is cylindrical in shape and tends to press into the wood after the nail has been driven. This is particularly true when the wood being assembled is of varying hardness or contains an excess amount of knots. In these situations, the nailing machine is usually set to drive a nail into an area having the greatest hardness. Unfortunately, when a nail is driven into a soft area, the cylindrical driver, under this highr impact setting, either indents the surface of the wood, drives the nail through the outer surface or splits the wood, thus causing a poor appearance or a scrap piece.

It has also been recognized that a fast acting, nail-driving piston is desirable in order to set the nail in a timely, economic manner. In this regard, air actuated, pneumatic pistons have been used in a variety of ways so as to effect a quick extension and retraction thereof. Generally, these devices employ a plurality of nested cylinders having various exhaust and inlet air ports machined therein in an effort to accomplish this end. Exemplary of such devices are the nail drivers shown in U.S. Pat. Nos. 3,049,713, 2,993,208 and 2,989,750. It is readily apparent that these cylinders add to the cost of the device due to the required machining, material and assembly expenses.

Our present invention solves many of the problems heretofore found in these prior devices by providing an automatic nailing machine which utilizes a supply of loose nails and is operable in any nailing direction i.e., vertical, horizontal, inverted or any other desired position therebetween.

The nailing machine of the present invention further provides a pneumatic device which delivers nails to the driving chamber of the machine in a fast and trouble-free manner with a minimum amount of moving parts so as to decrease the probability of jamming, expensive down-time and needless maintenance.

Our present invention still further provides an automatic nailing machine having a single, air actuated cylinder with air exhaust means associated therewith to permit instantaneous extension and retraction of the nail driving piston therewithin. In addition, our invention provides a nail driving machine which drives the nail to a uniform depth without splitting the wood.

The nail driving machine of the present invention achieves these desirable features by providing a transfer tube which feeds loose nails, by pressurized air, at high velocity, to an inclined X-shaped alignment chamber which is positioned adjacent to a sidewall of the guide channel of the pneumatic ram. A magnet is positioned along an opposed sidewall of the guide channel to attract the inclined nail and place the nail in an aligned position within the guide channel of the driving ram. The pneumatically driven ram is rectangular in cross-section and carries a slightly extended, nail seating tip, which engages the head of the nail and countersinks the nail to a depth equivalent to the length of the seating tip. The larger, rectangular surface area of the ram, surrounding the seating tip, strikes the surface of the wood and acts as a stop, preventing further extension of the ram, thus preventing any damage to the wood. Our invention further provides a rotatable sleeve having exhaust ports formed therein positioned on the base of the driver cylinder. When the ram piston is moved through a work or extension cycle, the sleeve automatically rotates to a closed position upon completion of the work cycle to permit a rapid, pressurized retraction of the ram piston. Air is rapidly exhausted from the cylinder during the retraction cycle by a poppet valve positioned on the cylinder head plate.

DETAILED DESCRIPTION OF THE INVENTION

Figures 1, 1A, 7, 8, 9:
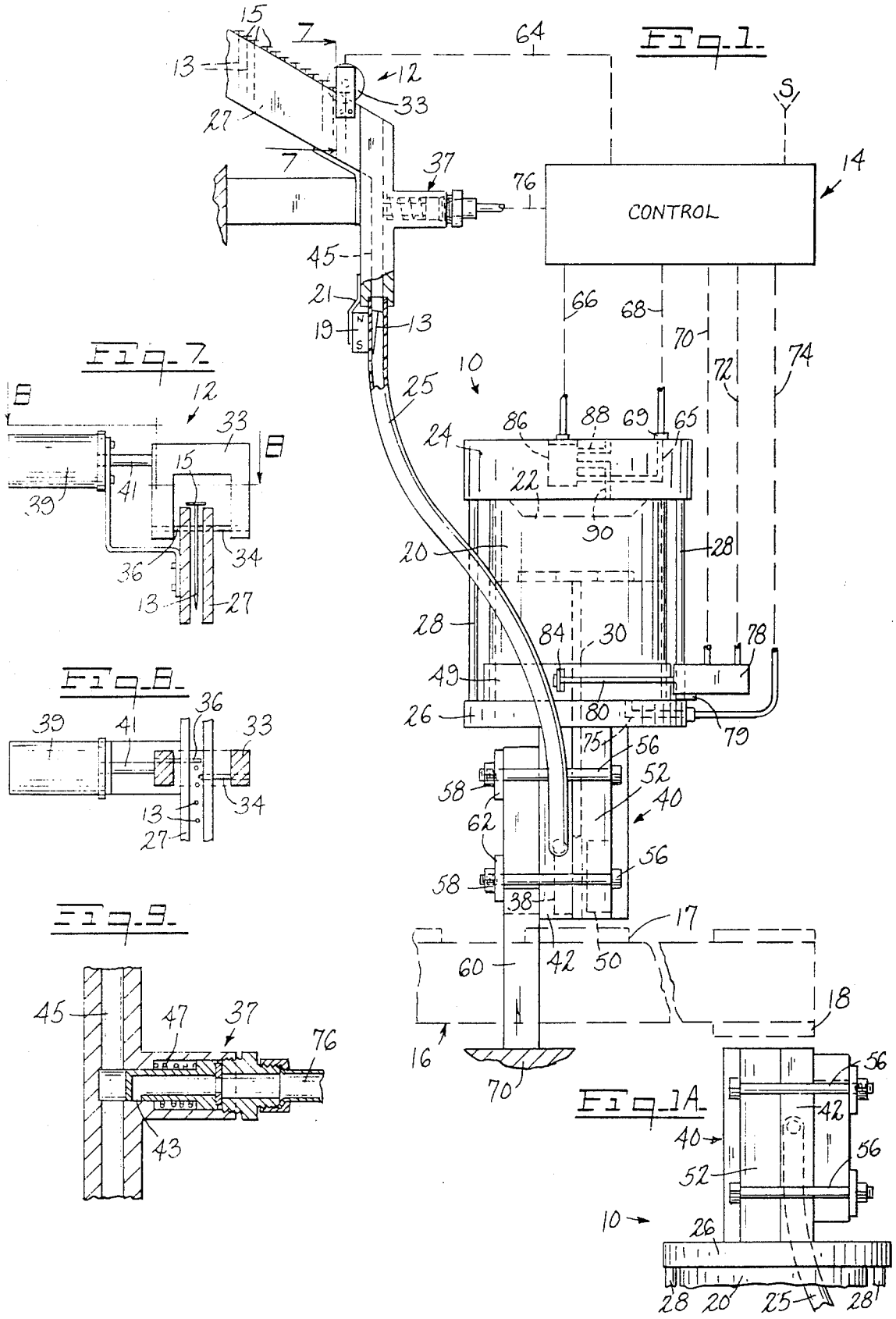
FIG. 1 is a longitudinal side view of a nailing machine of the present invention.
FIG. 1A is a partial side view of the nailing machine of FIG. 1, in an inverted nailing position.
FIG. 7 is a partial, sectional view of a nail feeder apparatus taken along line 7—7 of FIG. 1.
FIG. 8 is a partial, sectional view taken along line 8—8 of FIG. 7.
FIG. 9 is an enlarged, cross-sectional view of a pressurized air valve for pneumatically conveying nails from the nail feeder to the nailing machine.
Figure 2:
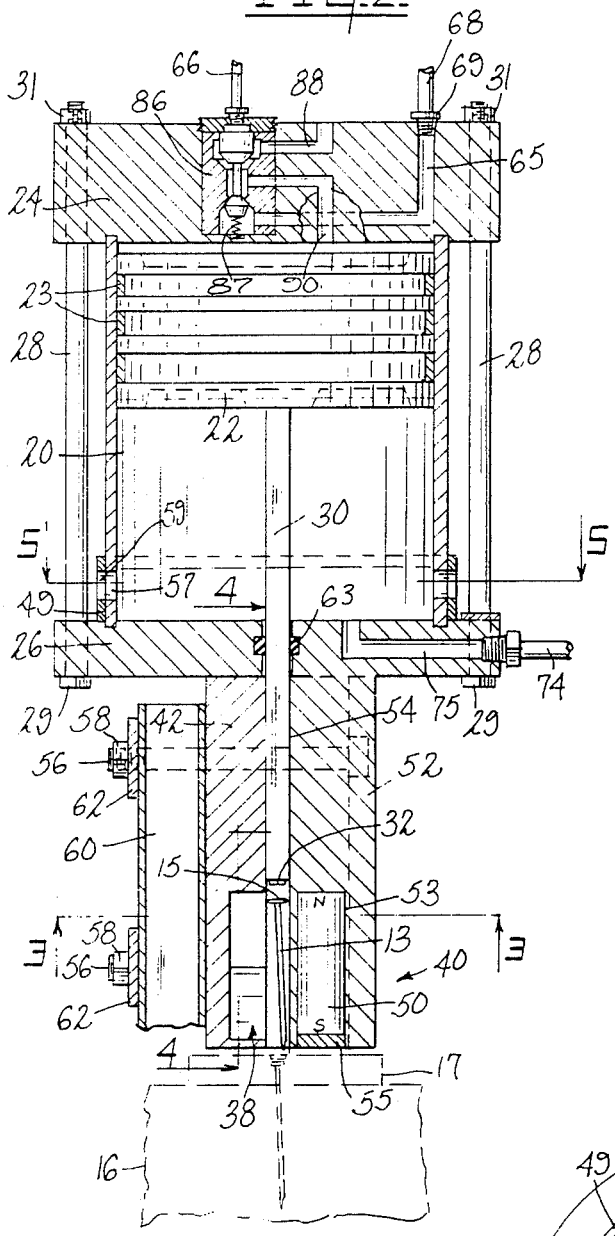
FIG. 2 is a cross-sectional view of the nailing machine of FIG. 1.

Referring now, more specifically to the drawings and, in particular, to FIGS. 1 and 2, a nailing machine 10 of the present invention is shown in a mounted position to automatically nail a wooden cross member 17 to the frame of a shipping pallet 16.

The nailing machine 10 is preferably energized by pressurized air supplied from a conventional, external source "S" which is connected to a pneumatic control, logic box 14, which, in turn, is pneumatically piped to the nailing machine 10 and to a nail feeder apparatus 12, the fuctions of which will be explained in greater detail hereinafter.

The nailing machine 10 includes a pneumatic cylinder 20 which has a head plate 24 and a base plate 26 secured thereto by way of a plurality of tie rods 28. As shown in FIG. 2, the tie rods 28 include bolt heads 29 and nuts 31 so as to insure an airtight seal around the ends of the cylinder 20. A piston 22, having conventional piston rings 23, is fitted within the cylinder 20 to pneumatically reciprocate therein. The piston 22 carries a driver ram 30 which travels in a guide path 35 within the nail driving section 40 of the machine 10. The driver ram 30 is pneumatically sealed by element 63 positioned within the plate 26.

Loose nails 13, having head portions 15, are fed by conventional means such as a vibrating bowl feeder (not shown) to an inclined magazine 12, whereupon they are delivered, individually, by a sorting head 33, to a pneumatic transfer tube 25 which rapidly conveys the nails 13 by way of timed, air blasts from a valve 37 to the driving section 40 of the machine.

Due to the fact that the nails 13 are conveyed by compresed air, the nailer can be operably positioned in any nailing direction. As shown in FIG. 1A, the nailing machine 10 is inverted, in a position to nail a lower cross brace 18 to the support frame of the pallet 16. In like fashion, the nailer is easily suitable for horizontal nailing operations or other positions therebetween.

Figure 3:
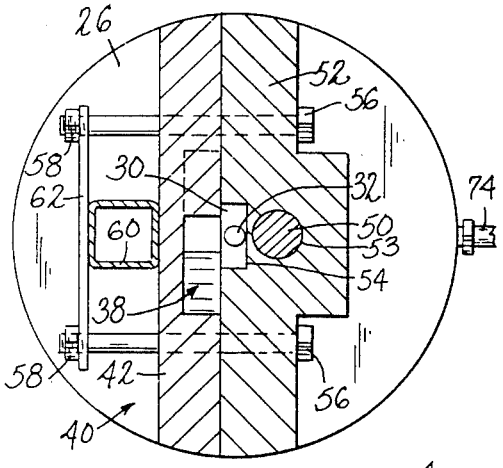
FIG. 3 is a cross-sectional view taken along line 3—3 of FIG. 2.
Figure 4:
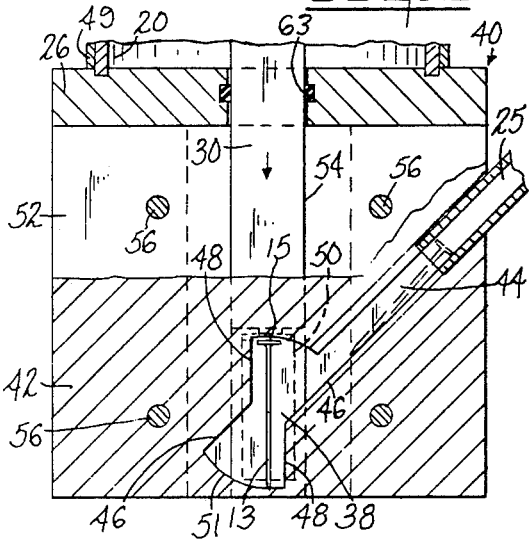
FIG. 4 is a cross-sectional view taken along line 4—4 of FIG. 2.

Referring now to FIGS. 2–4, the rapidly moving nail 13 is delivered by the pneumatic tube 25 to an alignment chamber 38 within the driving section 40. The alignment chamber 38 is "X"-shaped in plan view, resembling an hour glass, and is machined in a plate 42 communicating with the pneumatic tube 25 by means of a slot 44. The alignment chamber 38 is positioned adjacent to the rectangular guide path 54 of the driver ram 30. The guide path 54 is machined in a matched, facing plate 52. The alignment chamber 38 includes a first pair of inclined legs 46, which are formed at an angle of about 45° relative to the longitudinal axis of the driver ram 30 and a second pair of legs 48 which are generally perpendicular to the ram 30. The nail 13 is conveyed by the tube 25 to the slot 44 whereupon the tip of the nail strikes a lower, curved surface 51 of the alignment chamber 38. A permanent magnet 50, preferably cylindrical in shape, is mounted within a cavity 53 which is formed in the plate 52, adjacent to the guide path 54 of the driver ram 30. The magnet 50 is firmly held in place within the cavity 53 by a cap 55, FIG. 2. The magnet 50 is positioned such that its curved surface is generally tangent to the center line of the driver ram 30 so as to magnetically attract and move the nail 13, instantaneously from the alignment chamber 38 in its delivered, inclined position to an upright driving position, within the guide path 54 of the driver ram 30. Due to the fact that the alignment chamber 38 is off-set relative to the guide path 54 of the ram 30, and because of the clearance provided by the inclined leg portions 46, the individual nails 13 can be fed thereto at high rapidity, with little chance of jamming due to irregularities in nail head dimensions.

As previously stated, the nail driving section 40 of our invention is constructed of a pair of machined, opposed, face plates 42 and 52 which are secured theretogether in a close fitting, matched arrangement by tie bolts 56. The bolts 56 are secured at their threaded ends by nuts 58 which compressively engage a plurality of cross-braces 62 which, in turn, engage a longitudinally extending support member 60. The support member 60, as shown in FIG. 1, may be mounted to a permanent, non-moveable structure, such as the floor 70.

Due to the fact that the magnet 50 will tend to induce a magnetic field within ferrous materials, the plates 42 and 52, as well as the driver ram 30, are preferably constructed of non-magnetic materials, such as brass, aluminum or non-magnetic stainless steel.

Referring now to the overall operation of the nailing machine 10, a conventional control, logic box 14 is shown in FIG. 1. The control box 14 contains various commercially available, pneumatically actuated, timing valves or similar, electrically motivated timers and solenoid devices. An external source of pressurized air "S" is pneumatically connected to the control box 14, which in turn, is piped, by way of air lines 64, 66, 68, 70, 72 and 74, to the nailing machine 10.

In order to feed nails individually, in a timed manner, an inclined, feeder channel 27 receives loose nails 13 from a conventional feeder means such as a vibrating bowl feeder (not shown). The nail heads 15 move on the top edge of the channel 27, by gravity, to a point where they are held by a sorting head 33. The sorting head 33 pneumatically reciprocates by way of air line 64 and a pneumatic cylinder 39 to individually sort the nails 13 prior to entry into the delivery tube 25. As can be seen in FIGS. 7 and 8, the cylinder 39 includes a reciprocating piston rod 41 which is secured to the sorting head 33. The sorting head 33 carries a pair of pins 34 and 36 which isolate individual nails 13, in a timed manner, by way of predetermined, bursts of air delivered from the control box 14 through the air line 64 to the cylinder 39. When the piston rod 41 retracts, the pin 36 releases the nail 13, as shown in FIGS. 1 and 8, and the nail falls into a channel 45 within the feeder 12. The nail 13 is then held by a magnet 19 which is mounted by a bracket 21 adjacent to the lower end of the feeder 12.

A pneumatic valve 37 is piped, by way of an air line 76, from the control box 14 and includes a nozzle 43 which is biased by a coil spring 47 to move, under the influence of pressurized air, within the feeder tube 45. In a predetermined, timed manner, the control box 14 delivers a burst of compressed air through the air line 76 which forces the valve 37 to extend, whereupon its valve nozzle 43 directs compressed air into the feeder tube 45 and the transfer tube 25. When this occurs, the nail 13 shown in FIG. 1 is rapidly transferred from its holding position adjacent to the magnet 19, through the transfer tube 25 to the alignment chamber 40 prior to being driven by the ram 30.

Of great importance in automatic nailing operations is the speed in which the machine is capable of functioning. In this regard, we have provided a fast acting, pneumatic piston with associated rapid exhaust means in order to achieve this desired feature. The piston 22 reciprocates within the cylinder 20 and is energized, in an extended, work stroke, by way of compressed air delivered, in a timed manner, from the control 14 through an air line 68 which is fitted to the cylinder head 24 by a conventional, threaded fitting 69. An air passage 65 is formed within the cylinder head 24 in communication with the air line 68 and the cylinder 20 to permit the passage of air to drive the piston 22.

Figure 5:
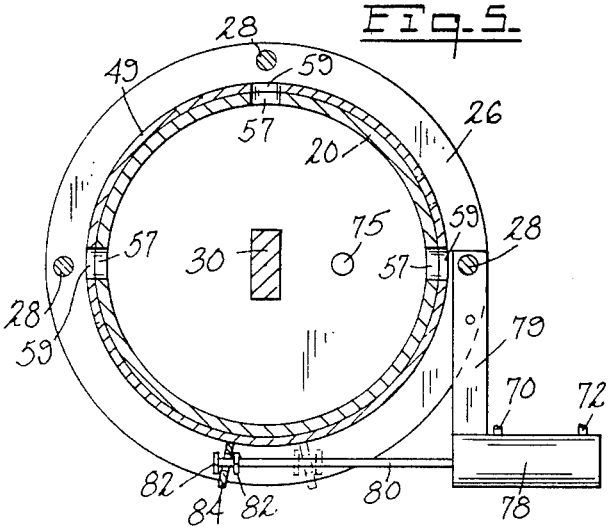
FIG. 5 is a cross-sectional view taken along line 5—5 of FIG. 2.
Figure 6:
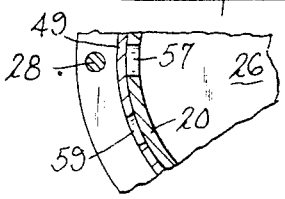
FIG. 6 is a fragmentary plan view of the exhaust sleeve and cylinder wall of FIG. 5 showing the exhaust ports in a closed position.

In order to drive the piston 22 and its associated ram 30 in a high velocity manner, it is necessary that entrapped air within the cylinder 20 be rapidly exhausted during the work stroke. In order to accomplish this end, we have provided a rotatable, exhaust sleeve 49 mounted on the exterior, base-end of the cylinder 20. The exhaust sleeve 49 has a plurality of ports 59 formed therethrough, which communicate, in an exhaust position, shown in FIG. 5, with exhaust ports 57 of the cylinder 20. The sleeve 49 carries an extended arm 84 which is attached by a pair of retaining nuts 82 to a ram 80 of a pneumatic piston 78. The piston device 78 is mounted to the base 26 of the cylinder 20 by way of a brace 79. Upon activation of air lines 70 and 72 from the control 14, the piston device 78 rotates the sleeve 49 from its exhaust position shown in FIG. 5 to the closed position shown in FIG. 6 in order to facilitate a rapid, pressurized retraction of the piston 22.

The piston 22 is retracted, in a timed manner, by way of compressed air delivered from the control 14 through an air line 74 to a channel 75 formed within the base plate 26. A conventional pneumatic poppet valve 86 is fitted within the cylinder head 24 in order to permit a rapid exhaust of the cylinder 20 when the piston is in its retraction cycle. The poppet valve 86 is normally open, in an exhaust mode, biased by a spring 87, so as to permit exhaust air to escape from the cylinder 20 through exhaust channels 88 and 90 which are formed within the cylinder head 24.

The poppet valve 86 is piloted, in timed fashion, by an air line 66 from the pneumatic control box 14. The poppet valve 86 is energized at the same time as the main working air line 68 to effect a downward movement of the poppet valve 86 in order to close the exhaust channels 88 and 90 during the compressive, working stroke of the piston 22.

As mentioned previously, the driving ram 30 is specially shaped so as to insure a uniform nail driving length in order to avoid needless scrap due to over-driving. The driving face of the ram 30 is rectangular in cross-section and includes an extended tip 32 which is adapted to strikingly engage the head 15 of the nail 13. In this manner, the nail 13 is driven into a substrate, such as the shipping pallet 16 to a uniform depth. The flat surface area provided by the rectangular ram 30 acts as a land or stop so as to inhibit further movement when the ram 30 strikes the nailed object. Thus, the driver tip 32 countersinks the nail head 15 to a uniform depth and the ram 30 abruptly halts after it strikes the upper surface of the wood so as to avoid over-driving and/or wood splitting.

As a result of the fast-acting, multi-directional, pneumatic nail feeder tube 25 and its associated nail alignment chamber 38, the nailing machine 10 of the present invention can be mounted in a variety of nailing positions, namely, vertical, horizontal, inverted or any desired position therebetween. As shown in FIG. 1A the nailer 10 is positioned in an inverted mode, ready to nail a lower cross brace 18 to the pallet 16. It is contemplated that a plurality of such nailing machines 10, arranged in a group, could be utilized, to automatically nail a work piece, simultaneously, from a variety of nailing positions in order to achieve a higher quality and less costly product than heretofore obtainable.

As our invention, we claim:

1. In a nailing machine of the type having a nail driving ram mounted therein for reciprocating travel along a longitudinal stroke path, and loose nail feeder means associated therewith, the improvement comprising:

(a) a nail alignment chamber in communication with and positioned in a plane adjacent to, but displaced from, the stroke path of the driving ram, the alignment chamber being adapted to receive nails from the nail feeder means at an angle to the stroke path of the driving ram and being dimensioned and configured so as to permit rotation of a received nail from the inclined delivery position to a position substantially parallel to the stroke path of the driving ram;

(b) nail transfer means for transferring individual nails from the loose nail feeder means to the alignment chamber, the nail transfer means having a feed path disposed at an inclined angle relative to the stroke path of the driving ram; and (c) a magnet located adjacent to the stroke path of the driving ram and being so positioned as to magnetically rotate a nail in the alignment chamber from the inclined delivery position to a position substantially parallel to the stroke path of the driving ram and to magnetically move the nail from the alignment chamber into a driving position aligned within the stroke path of the driving ram.

2. The nailing machine of claim 1 wherein the nail transfer means comprises a pneumatic transfer tube extending from the nail feeder means to the alignment chamber for transferring nails under pressurized air through the transfer tube to the alignment chamber.

3. The nailing machine of claim 2 wherein the nail transfer means includes a magnet positioned adjacent to the pneumatic transfer tube for holding each individual nail in position prior to transferring the nail to the alignment chamber under pressurized air.

4. The nailing machine of claim 1 wherein the alignment chamber comprises a substantially x-shaped chamber, with one leg of the x-shape being positioned parallel to and in communication with the stroke path of the driving ram, and the other leg being disposed at an angle thereto and in communication with the nail transfer means for receiving nails therefrom.

5. A nailing machine comprising:

(a) an air actuated piston, reciprocally mounted within a cylinder, said cylinder including head and base plates secured thereto;

(b) a nail driving ram carried by said piston and movable along a stroke path within a driving portion of the nailing machine;

(c) a pneumatic transfer tube for transferring nails from a feeder means to the driving portion of said nailing machine;

(d) a nail alignment chamber in communication with and positioned in a plane adjacent to, but displaced from, the stroke path of the driving ram, the alignment chamber being adapted to receive nails from the nail feeder means at an angle to the stroke path of the driving ram and to permit rotation of a received nail from the inclined delivery position to a position substantially parallel to the stroke path of the driving ram; and (e) a magnet located adjacent to the stroke path of the driving ram and being so positioned as to magnetically rotate a nail in the alignment chamber from the inclined delivery position to a position substantially parallel to the stroke path of the driving ram and to magnetically move the nail from the alignment chamber into a driving position aligned within the stroke path of the driving ram.

6. The nailing machine of claim 5 including a sleeve member having a plurality of exhaust ports formed therethrough and communicating, in a first position, with exhaust ports formed within the cylinder, rotatably mounted adjacent to the base plate thereof to permit exhaust air to pass therethrough when the piston moves through an extended, working stroke, said sleeve having pneumatic means associated therewithin to move the sleeve to a second, closed position whereby the exhaust ports of the cylinder are sealed by said sleeve when the piston moves in a retraction stroke.

7. The nailing machine of claim 6 including valve means positioned within the cylinder head plate to permit a rapid exhausting of air from the cylinder when the piston moves in a retraction stroke.

8. The nailing machine of claim 5 wherein the driver ram is rectangular in cross-section and carries an extended tip thereon which is adapted to engage and countersink a head of a nail when driven by the pneumatic piston.

* * * * *

UNITED STATES PATENT AND TRADEMARK OFFICE

CERTIFICATE OF CORRECTION

PATENT NO. : 4,487,355

DATED : December 11, 1984

INVENTOR(S) : Oscar Ginnow and Roger Ginnow

It is certified that error appears in the above-identified patent and that said Letters Patent are hereby corrected as shown below:

Col. 3, line 36, delete "35" after path and substitute -- 54 --

Col. 3, line 42, delete "magazine 12" and substitute -- channel 27 --

Col. 4, line 59, delete "1" after FIGS. and substitute -- 7 --

Signed and Sealed this

*Eighteenth* Day of *June 1985*

[SEAL]

*Attest:*

DONALD J. QUIGG

*Attesting Officer* *Acting Commissioner of Patents and Trademarks*